United States Patent [19]

DeVito

[11] 3,989,345

[45] Nov. 2, 1976

[54] SPRING BINDING POST

[75] Inventor: Charles P. DeVito, Woodale, Ill.

[73] Assignee: Chromalloy-Alcon, Inc., Chicago, Ill.

[22] Filed: Mar. 14, 1975

[21] Appl. No.: 558,543

[52] U.S. Cl. ..... 339/254 R; 339/220 R

[51] Int. Cl.[2] ..... H01R 11/22

[58] Field of Search ..... 339/220 R, 254 R, 254 M, 339/255 B

[56] References Cited

UNITED STATES PATENTS 3,478,304 11/1969 Valle ..... 339/254 R

FOREIGN PATENTS OR APPLICATIONS 1,032,402 3/1953 France ..... 339/254 M

*Primary Examiner*—Roy Lake
*Assistant Examiner*—Mark S. Bicks
*Attorney, Agent, or Firm*—Hill, Gross, Simpson, Van Santen, Steadman, Chiara & Simpson

[57] ABSTRACT

A simple three-piece binding post is provided having a hollow generally tubular housing for mounting on a support such as a binding post panel, a binding plunger reciprocable within the housing, and a spring for engagement with the support and for thrusting the plunger to bind a lead terminal inserted into normally offset but alignable lead-receiving openings in the housing and plunger.

5 Claims, 6 Drawing Figures

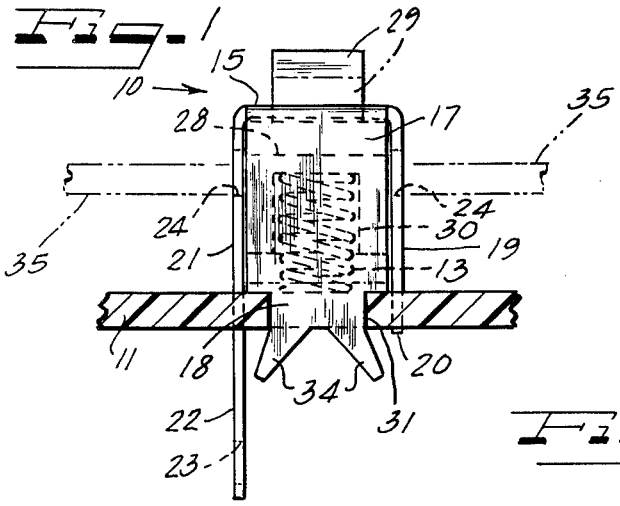
Fig. 1
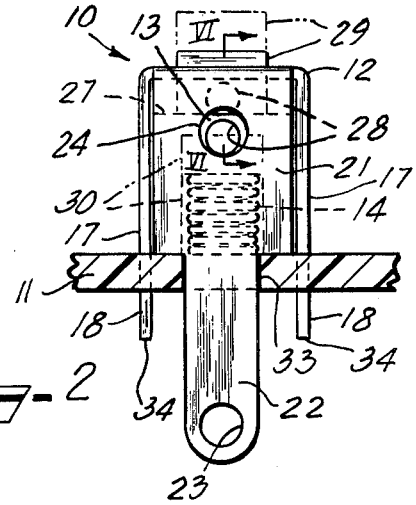
Fig. 2
Fig. 3
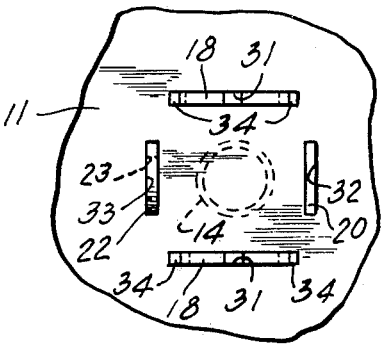
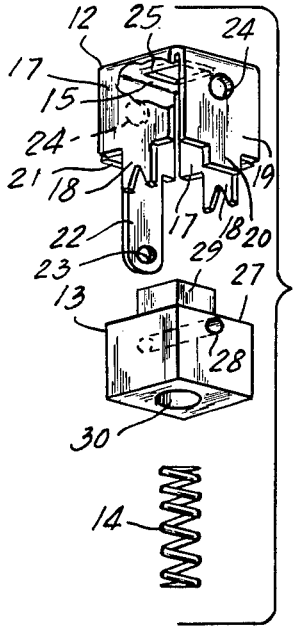
Fig. 4
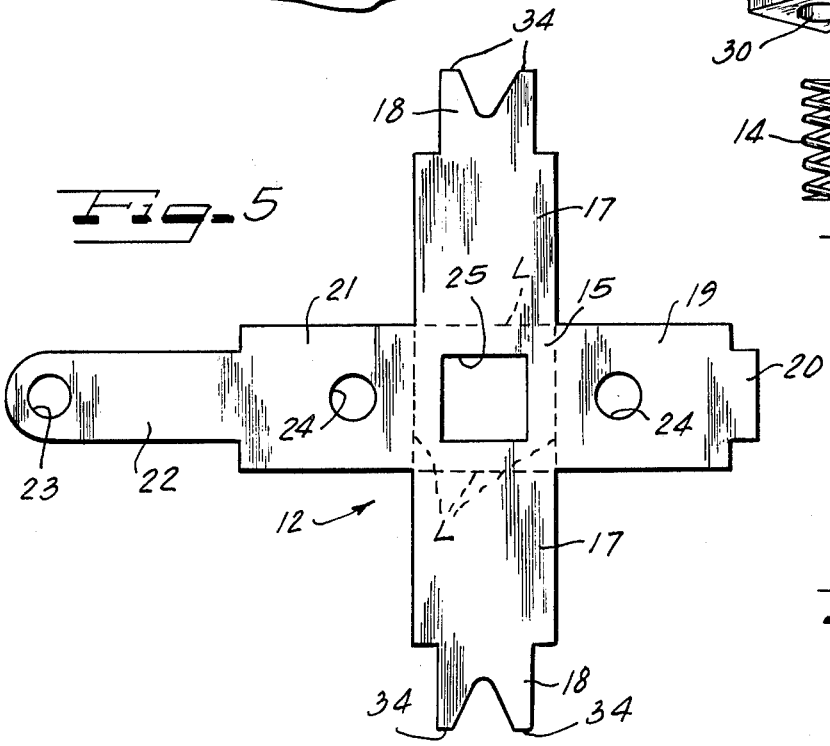
Fig. 5
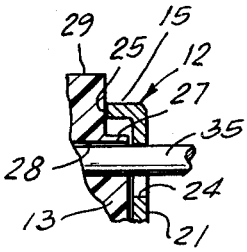
Fig. 6

SPRING BINDING POST

This invention relates to spring binding posts for solderless connection of electrical leads.

Spring binding posts, as such, are well known in electrical connector art. All prior constructions, however have one or more objectionable features, not the least of which is complexity of structure, involving numerous parts, costly to produce and assemble.

It is therefore an important object of the present invention to provide a new and improved spring binding post which will overcome the disadvantages, defficiencies, inefficiencies, shortcomings and problems in respect to prior structures, and to provide a substantially improved, simplified, efficient, low-cost spring binding post structure.

Another object of the invention is to provide a new and improved spring binding post construction comprising three simple easily assembled and efficient components.

According to features of the invention, a spring binding post is provided which comprises a hollow generally tubular housing having a base end and a head end, the base end having an endwise opening and means for mounting the housing on a support and an electrical terminal, the head end having an endwise opening and an inwardly facing shoulder, a plunger shorter than the housing having a head end and a base end and reciprocably mounted within the housing, a head end projection on the plunger protruding through the head end opening of the housing, a stop shoulder on the head end of the plunger engageable with the inwardly facing housing shoulder, biasing spring means within the housing for normally thrusting against the base end of the plunger and through the base end opening in the housing against the support to bias the plunger toward the inwardly facing housing shoulder, and the housing and the plunger having respective lateral electrical lead-receiving openings which are normally relatively offset and adapted to be aligned by pressing in opposition to the biasing spring means inwardly on the plunger projection, for receiving an electrical lead to be bound to the binding post by gripping coaction of surfaces of the housing and the biased plunger at the lead-receiving openings.

According to other features of the invention, the base end mounting means and electrical terminal comprise projections from the base end of the housing to extend through holes punched for this purpose through a binding post mounting panel.

Other objects, features and advantages of the invention will be readily apparent from the following description of a preferred embodiment thereof, taken in conjunction with the accompanying drawing although variations and modifications may be effected without departing from the spirit and scope of the novel concepts embodied in the disclosure, and in which:

FIG. 1 is a side elevational view of a spring binding post embodying features of the invention and showing the same mounted on a support comprising a binding post panel;

FIG. 2 is another side elevational view of the mounted spring binding post, but turned 90° relative to FIG. 1;

FIG. 3 is a bottom plan view of the mounted binding post;

FIG. 4 is an exploded assembly view of the unmounted spring binding post;

FIG. 5 is a developed blank from which the housing for the spring binding post is formed; and FIG. 6 is a fragmentary sectional view taken on substantially the line VI—VI of FIG. 2 and showing a lead wire terminal releasably bound to the post.

A spring binding post 10 (FIGS. 1 and 2) embodying features of the invention is constructed and arranged to be mounted on a support preferably comprising a dielectric binding post panel 11. According to a preferred embodiment, the spring binding post 10 comprises just three components (FIG. 4), namely, a hollow generally tubular housing 12, a plunger 13, and biasing spring means desirably in the form of a helically called compression spring 14.

In a preferred form, the housing 12 is formed from a single piece of electrically conductive material, conveniently in the form of a sheet metal stamping, the developed blank for which is shown in FIG. 5. Although other geometrical cross sectional shapes may be employed, a desirable, easily produced shape is square. To this end, the housing blank is provided with a central head end portion 15 from which project diametrically opposite, preferably identical side wall panels 17 each of which is provided with a narrower bifurcated attachment lug 18 extending from the distal end of the associated panel 17. Symmetrically related to and projecting from the head portion 15 between the wall panels 17 on the blank are oppositely extending wall panels the main area of which is identical to the area of the panels 17 and comprising a wall panel 19 having a straight narrower attachment stabilizing lug 20 extending from its distal end, and an oppositely extending wall panel 21 provided with an elongated narrower solder lug terminal 22 extending from its distal end. A solder hole 23 is desirably provided in the distal end portion of the extension terminal 22. Adjacent to but spaced from head portion 15 each of the body panels 19 and 21 has a preferably identical lead-receiving opening 24. Centrally in the head portion 15 is a clearance opening 25 with solid area of the head portion about the opening 25. All that is required to complete forming of the housing 12 is to bend the blank along lines L shown in FIG. 5, outlining the head portion 15 across the proximal ends of the body panels, and join the contiguous edges of the body panels and with the body panels extending normal to the head portion 15, substantially as shown in FIGS. 1, 2 and 4. As thus formed up, the distal ends of the body panels 17, 19 and 21 lie in a common base plane, defining the base end of the housing 12 and providing an endwise base opening from the housing.

In a preferred form, the plunger 13 is constructed as a one-piece block, desirably molded dielectric member, the material for which may be any suitable rigid plastic. In its perimeter, the plunger 13 is complementary to and sufficiently differentially smaller than the transverse inside dimensions within the housing 12 so as to be freely reciprocably mounted within the housing. In length, the body of the plunger 13 is sufficiently shorter than the length of the chamber within the housing 12 to provide for a limited range of reciprocable movement between a position wherein a stop shoulder 27 on the head end on the plunger engages against the inwardly facing shoulder provided by the head portion 15 of the housing, and an opposite reciprocable position wherein the base end of the plunger assumes a position in a plane with the base ends of the housing side wall panels. In the position wherein the stop shoulder 27 engages against the head shoulder of the housing, a transverse lead-receiving opening preferably in the form of a clear through bore 28 in the plunger 13 closely adjacent to the shoulder 27 is offset toward the head end of the housing 12 relative to the aligned lead-receiving openings 24 in the wall panels 19 and 21 of the housing, but with which openings 24, the opening 28 is placed in generally axial alignment when the plunger 13 is moved away from the housing head shoulder area 15 and into alignment of the base end of the plunger with the base ends of the housing walls panels, whereby to enable the reception of a terminal end portion of an electrical lead in the aligned housing and plunger openings from either or both opposite sides of the housing. To facilitate shifting the plunger 13 inwardly, its head end is provided with a manipulating knob projection 29 dimensioned to project through the head opening 25 of the housing.

To facilitate assembly of the biasing spring 14 with the plunger 13, the diameter of the spring 14 is substantially smaller than the diameter of the plunger 13, and the plunger is provided with a central blind end bore socket 30 which opens through the base end of the plunger and receives an end portion of the spring therein, with the spring projecting to a substantial extent beyond the base end of the plunger.

It will thus be apparent that assembling of the three components of the spring binding post 10 simply comprises inserting the prefabricated plunger 13 into the prefabricated housing 12, with the openings 24 and 28 oriented for alignment, and assembling the spring 14 into the socket 30. As thus assembled, the binding post 10 is ready to be mounted on the supporting panel 11. Such mounting is effected in an extremely simple manner and comprises simply projecting the connecting lug extensions 18 through complementary spaced parallel slots 31 formed in the panel 11, and projecting the stabilizing lug extension 20 through a complementary slot 32 formed in the panel and projecting the solder lug terminal 22 through a complementary slot 33 formed in the panel. In effecting such assembly, the solder lug terminal 22 being the longer of the projections may be used as a pilot, starting it through its slot 33, and then continuing the relative assembly until the lugs 18 and 20 have been received through their respective slots 31 and 32 and until the base ends of the housing wall panels seat against the panel 11. Permanent retention of the binding posts 10 on the panel 11 is assured by spreading bifurcated locking tabs 34 on the lugs 18 from parallel alignment with the opposite edges of the lugs into a relatively divergent relation after full assembly of the binding posts with the panel 11, substantially as shown in FIGS. 1 and 3, wherein the locking or anchoring lugs 34 are spread to a greater width than the length of the slots 31 whereby to lock the lugs 18 and thereby also the lug 20 and the terminal 22 against withdrawal from the panel 11, and also drawing the base ends of the housing wall panels firmly against the panel 11. In such mounting of the binding post 10 on the panel 11, the biasing spring 14, which is of sufficient length for this purpose, is placed under permanent compression between the plungers 13 and the area of the panel 11 circumscribed by the slots 31, 32 and 33. Therefore the plunger 13 is normally biased toward the head portion 15 of the housing.

After the binding post 10 has been mounted and affixed to the panel 11, one or a pair of electrical leads 35 (FIGS. 1 and 6) can be readily electrically coupled with the binding post by simply pressing in on the projecting head knob 29, against the bias of the spring 14 to bring the plunger opening 28 into lead-receiving alignment with the housing openings 24, such alignment being readily gauged by bottoming of the base end of the plunger 13 against the panel 11, as shown in FIG. 2. Upon insertion of the terminal end portion of the electrical wire lead 35 into the aligned openings 24, 28, and release of the plunger from counter-bias pressure against the knob 29, the biasing spring 14 thrusts the plunger toward the head portion 15 of the housing whereby there is effected a transverse clamping, binding coaction of the surfaces of the housing and the biased plunger at the lead-receiving openings 24 and 28. In particular, this causes the terminal portion of the electrical wire lead to be firmly transversely grippingly biased against the edge defining the opening 24 in the housing wall, as best seen in FIG. 6, for efficient electrical contact. Thereby, electrical connection may be effected between a pair of the electrical leads 35 extending in alignment through the opposite lead-receiving openings 24, and if desired with one or more leads solder coupled to the solder lug terminal 22. Of course, there may be simply a one-to-one electrical connection between a single electrical lead at each end of the binding post, namely one at the solder lug 22 and one in solderless coupled relation through either one of the coupling holes 24.

It will be understood that variations and modifications may be effected without departing from the spirit and scope of the novel concepts of this invention.

I claim as my invention:

1. In combination, a spring binding post comprising a hollow generally tubular housing having a head end portion and a base end from which a plurality of substantially flat mounting extensions and an electrical terminal extension project, and a supporting panel against which said base end seats, said panel having complementary slots through which said mounting extensions and said terminal extensions engage:

said head end portion having an opening therethrough and an inwardly facing shoulder;

a plunger shorter than the housing and having a head end and a base end and mounted reciprocably within the housing, a head end manipulatable knob projecting from the plunger through said head end opening and a biasing spring thrusting the plunger toward engagement with said shoulder, the housing and the plunger having electric lead-receiving coupling openings which are adapted to be placed in registration by pushing in on the knob of the plunger;

respective pairs of interlock bifurcations extending from the distal ends of said mounting extensions and lying in the flat plane of the respective extension from which they extend;

and said interlock bifurcations of each pair being displaced relative to one another in the respective plane of their mounting extension into locking relation to said supporting panel by engagement against ends of the slots through which the mounting extensions extend.

2. A spring binding post, comprising:

a hollow generally tubular housing having a head end portion and a base end having an endwise opening and a plurality of extensions receivable in complementary slots in a supporting panel, the head portion having an endwise opening and an inwardly facing shoulder;

a plunger shorter than the housing and having a head end and a base end, the plunger being mounted reciprocably within the housing;

a head end manipulatable knob projection on the plunger protruding through the head end opening of the housing;

a stop shoulder on the head end of the plunger for engagement with said inwardly facing shoulder;

biasing spring means within the housing for thrusting against the base end of the plunger and for thrusting through said base end opening in the housing against the support to normally bias said plunger and thereby said stop shoulder toward said inwardly facing shoulder;

said housing and said plunger having respective lateral electric lead-receiving coupling openings which are normally offset and adapted to be aligned by pressing, in opposition to said biasing spring means, inwardly on said knob for receiving an electrical lead into the aligned openings to be coupled to the binding post by then releasing the plunger for gripping coaction of coupling surfaces at the coupling openings of the housing and the biased plunger;

said housing comprising a one-piece formed up sheet metal member having four side wall panels bent from said head end portion and extending in substantially normal relation thereto, the wall panels having their side edges adjacent to one another and having distal ends in substantially a common plane at the base end of the housing;

one of said wall panels having an electrical terminal extension projecting from its distal end;

two others of said panels having mounting extensions projecting from their distal ends;

and the remaining of said wall panels having a stabilizing extension projecting from its distal end.

3. A spring binding post according to claim 2, wherein said mounting extensions have respective pairs of interlock bifurcations extending from their distal ends, said bifurcations of each of said pairs being displaceable relative to one another into locking relation to a supporting panel.

4. A spring binding post according to claim 3, wherein said interlock bifurcations are deformable by spreading them apart in substantially the plane of the wall panel from which they extend.

5. A spring binder according to claim 2, wherein said head end portion is continuous and solid about said head end endwise opening, said head end portion being substantially square, and said wall panels extending from the respective outside boundaries of said end portion.

* * * * *